US008743663B2

(12) United States Patent
Hosobuchi

(10) Patent No.: US 8,743,663 B2
(45) Date of Patent: Jun. 3, 2014

(54) POINTER TYPE TIMEPIECE

(71) Applicant: Casio Computer Co., Ltd., Tokyo (JP)

(72) Inventor: Hiroyuki Hosobuchi, Iruma (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 13/786,048

(22) Filed: Mar. 5, 2013

(65) Prior Publication Data

US 2013/0235705 A1 Sep. 12, 2013

(30) Foreign Application Priority Data

Mar. 6, 2012 (JP) ..... 2012-049274

(51) Int. Cl.
*G04B 19/253* (2006.01)

(52) U.S. Cl.
CPC ..... *G04B 19/253* (2013.01); *G04B 19/25333* (2013.01)
USPC ..... 368/28; 368/37

(58) Field of Classification Search
CPC ..... G04B 19/253; G04B 19/25333; G04B 19/25335
USPC ..... 368/28, 35, 37, 77, 223, 233
See application file for complete search history.

(56) References Cited

U.S. PATENT DOCUMENTS

| | | | | |
|---|---|---|---|---|
| 4,142,363 | A * | 3/1979 | Guyot et al. | 368/28 |
| 5,384,755 | A * | 1/1995 | Ferenczy | 368/35 |
| 6,097,672 | A * | 8/2000 | Kitahara et al. | 368/35 |
| 2006/0221773 | A1 * | 10/2006 | Kuepfer et al. | 368/37 |

FOREIGN PATENT DOCUMENTS

JP 2009-198437 A 9/2009

* cited by examiner

*Primary Examiner* — Vit W Miska
(74) *Attorney, Agent, or Firm* — Holtz Holtz Goodman & Chick PC

(57) ABSTRACT

A high-speed rotating wheel rotates at high speed by a third stepper motor which meshes with a portion of teeth of a ratchet wheel. A transmission projection of the ratchet wheel moves within an elongated hole of a transmission wheel which rotates with the movement of the hour hand. The ratchet wheel rotates at high speed, and a display wheel rotates at high speed by the high speed rotation of the ratchet wheel via a feed wheel. When normally moving the hour hand, the ratchet wheel rotates with the transmitting wheel and the portion of teeth of the ratchet wheel is made to approach the high-speed rotating wheel. When the display of the display wheel changes, the high-speed rotating wheel meshes with the portion of teeth of the ratchet wheel and rotates the ratchet wheel at high-speed. Accordingly, the date display of the display wheel can be quickly changed.

10 Claims, 13 Drawing Sheets

POINTER TYPE TIMEPIECE

CROSS-REFERENCE TO RELATED APPLICATION

This application is based upon and claims the benefit of priority from the prior Japanese Patent Application No. 2012-049274, filed Mar. 6, 2012, the entire contents of which is incorporated herein by reference.

BACKGROUND OF THE INVENTION

1. Field of the Invention

The present invention relates to a pointer type timepiece, such as a wristwatch, a mantelpiece clock, a wall clock, etc.

2. Description of the Related Art

For example, as described in Japanese Patent Application Laid-Open (Kokai) Publication No. 2009-198437, in a pointer type wristwatch, the rotation of a stepper motor is transmitted to a pointer wheel by an intermediate wheel, and the rotation of the pointer wheel is transmitted to a transmitting wheel, which is a Geneva wheel, by another intermediate wheel.

Next, a ratchet wheel is rotated with the rotation of the transmitting wheel, and a feed wheel is intermittently rotated by the ratchet wheel.

Also, an display wheel displaying the date, the day of the week, etc. is changed by rotating the display wheel with the feed wheel.

However, in this type of pointer type wristwatch, the ratchet wheel performs one revolution in 24 hours with the transmitting wheel. The feed wheel is rotated by a predetermined angle for each one revolution of the ratchet wheel. The display wheel is rotated by a predetermined angle with the rotation of the feed wheel by the predetermined angle, whereby the display of the date, the day of the week, etc. is changed.

Therefore, the time required from starting the display wheel rotation to completing a display change takes about three to four hours. There is a problem in that the display will be in a state where the display deviates midway during this period.

SUMMARY OF THE INVENTION

An object of the present invention is to provide a pointer type timepiece capable of quickly changing the display of the date, the day of the week, etc. in a state where the pointer moves normally.

In order to achieve the above-described object, in accordance with one aspect of the present invention, there is provided a pointer type timepiece comprising: a motor; a pointer which moves by rotation of the motor; a rotating wheel which rotates and transmits rotation of the motor; a ratchet wheel which is rotatably provided coaxially overlapped with the rotating wheel and provided with feed teeth in an outer peripheral portion; a feed wheel which has a plurality of tooth sections that mesh with the feed teeth of the ratchet wheel and rotate by a predetermined angle for every one revolution of the ratchet wheel; a display wheel which rotates by rotation of the feed wheel and changes display; and a high speed rotating wheel which rotates by rotation of the motor and rotates at a higher speed than the rotating wheel, wherein the ratchet wheel is provided with a locking section and an engaging section formed in the rotating wheel along a circumferential direction by which the locking section is movably locked into the engaging section, wherein the rotating wheel and the ratchet wheel integrally rotate when the locking section is locked into one end section of the engaging section positioned on opposite side of rotation direction of the engaging section, wherein the ratchet wheel is formed with a portion of teeth which mesh with the high speed rotating wheel only when the portion of teeth rotate the display wheel, wherein the ratchet wheel is rotated at high speed by which the high speed rotating wheel meshes with the portion of teeth, and then the locking section of the ratchet wheel moves in the rotation direction along the engaging section of the rotating wheel by the rotation of the high speed rotating wheel, and wherein the display wheel is also rotated at high speed by which the high speed rotation of the ratchet wheel is transmitted to the display wheel by the feed wheel.

In order to achieve the above-described object, in accordance with another aspect of the present invention, there is provided a pointer type timepiece comprising: a motor; a pointer which moves by the rotation of the motor; a rotating wheel which rotates and transmits rotation of the motor; a ratchet wheel which is rotatably provided coaxially overlapped with the rotating wheel and provided with feed teeth in an outer peripheral portion; a feed wheel which has a plurality of tooth sections that mesh with the feed teeth of the ratchet wheel and rotate by a predetermined angle for every one revolution of the ratchet wheel; a display wheel which rotates by rotation of the feed wheel and changes display; and a high speed rotating wheel which rotates by rotation of the motor and rotates at a higher speed than the rotating wheel, wherein the ratchet wheel is provided with a locking section and an engaging section formed in the rotating wheel along a circumferential direction by which the locking section is movably locked into the engaging section, wherein the rotating wheel and the ratchet wheel integrally rotate when the locking section is locked into one end section of the engaging section positioned in rotation direction side of the engaging section, wherein the ratchet wheel is formed with a portion of teeth which mesh with the high speed rotating wheel only when the portion of teeth rotate the display wheel, wherein the ratchet wheel is rotated at high speed by which the high speed rotating wheel meshes with the portion of teeth, and then the locking section of the ratchet wheel moves in the rotation direction along the engaging section of the rotating wheel by rotation of the high speed rotating wheel, and wherein the display wheel is also rotated at high speed by which the high speed rotation of the ratchet wheel is transmitted to the display wheel by the feed wheel.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

An embodiment in which the present invention has been applied to a pointer type wristwatch will hereinafter be described with reference to FIG. 1 to FIG. 13A and FIG. 13B.

Figure 1:
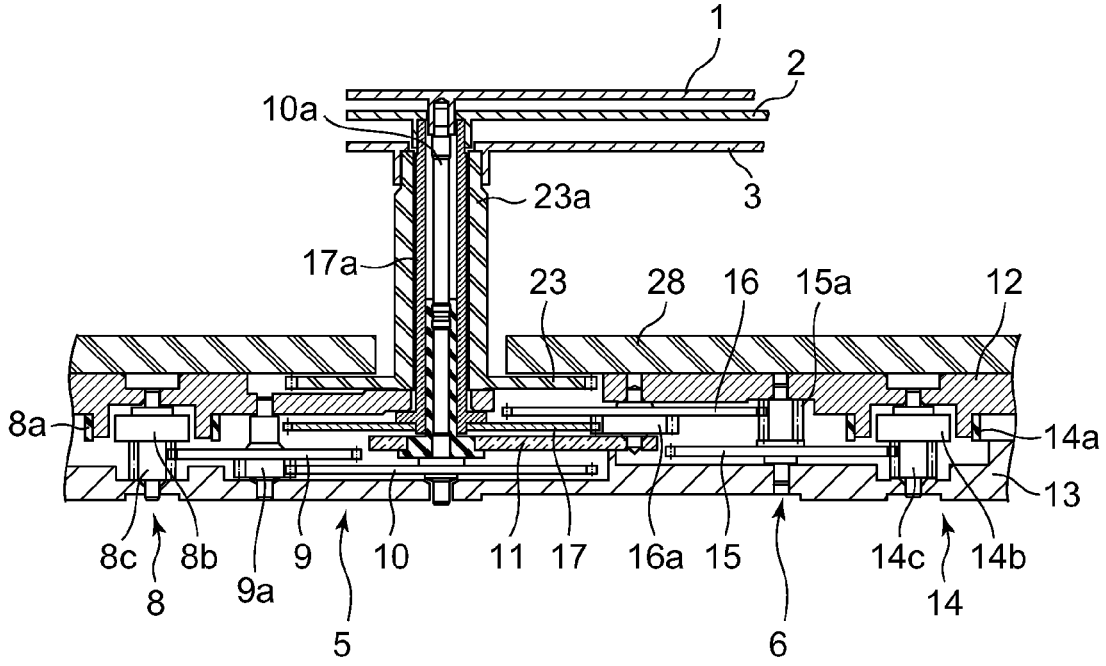
FIG. 1 is an enlarged cross-sectional view of main sections of a first drive system and a second drive system according to an embodiment in which the present invention is applied to a pointer type wristwatch.
Figure 2:
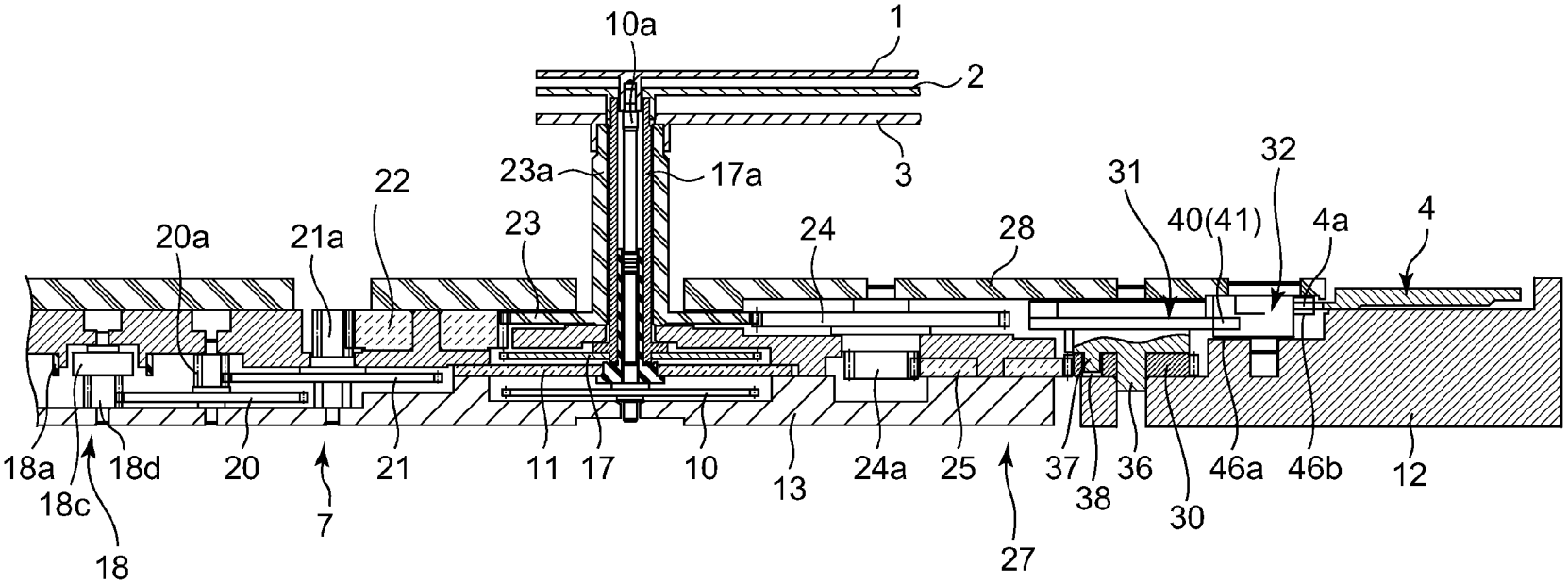
FIG. 2 is an enlarged cross-sectional view of main sections of a third drive system and a display changing device in the wristwatch shown in FIG. 1.

The wristwatch includes: a first drive system 5 that drives a second hand 1; a second drive system 6 that drives a minute hand 2; and a third drive system 7 that drives an hour hand 3 and a display wheel 4, as shown in FIG. 1 and FIG. 2.

The first drive system 5 includes: a first stepper motor 8; an fifth wheel 9 that is rotated by the first stepper motor 8; and a second hand wheel 10, which is a fourth wheel, that is rotated by the fifth wheel 9, as shown in FIG. 1. These components are arranged between a base plate 12 and a gear train bridge 13.

In this structure, the first stepper motor 8 includes: a stator 8*a*; a coil section (not shown) that is provided in the stator 8*a*; and a rotor 8*b* that is arranged within the stator 8*a*, as shown in FIG. 1. The rotor 8*b* is rotated in steps by a magnetic field generated in the stator 8*a* by the coil section.

The fifth wheel 9 meshes and rotates with a rotor pinion 8*c* of the rotor 8*b* of the first stepper motor 8.

The second hand wheel 10, which is the fourth wheel, meshes and rotates with a pinion 9*a* of the fifth wheel 9, thereby moving the second hand 1, as shown in FIG. 1.

The second hand wheel 10 includes a second hand shaft 10*a*.

The second hand shaft 10*a* is rotatably attached to a center wheel bridge 11 provided on the gear train bridge 13. In this state, the second hand shaft 10*a* projects upward through the base plate 12, and the second hand 1 is attached to an upper end portion of the projected second hand shaft 10*a*.

In addition, the second drive system 6 includes: a second stepper motor 14; an intermediate wheel 15 that is rotated by the second stepper motor 14, a third wheel 16 that meshes and rotates with a pinion 15*a* of the intermediate wheel 15; and a minute hand wheel 17, which is a second wheel, that is rotated by a pinion 16*a* of the third wheel 16, as shown in FIG. 1.

These components are arranged between the base plate 12 and the gear train bridge 13.

In this structure, the second stepper motor 14 comprises: a stator 14*a*; a coil section (not shown) that is provided in the stator 14*a*; and a rotor 14*b* that is arranged within the stator 14*a*, in a manner similar to the first stepper motor 8 of the first drive system 5.

The second stepper motor 14 is configured such that the rotor 14*b* is rotated in steps by a magnetic field generated in the stator 14*a* by the coil section.

The intermediate wheel 15 is rotatably arranged between the base plate 12 and the gear train bridge 13, as shown in FIG. 1.

The intermediate wheel 15 meshes and rotates with a rotor pinion 14*c* of the rotor 14*b* of the second stepper motor 14.

The third wheel 16 is rotatably arranged between the base plate 12 and the center wheel bridge 11.

In this state, the third wheel 16 meshes and rotates with the pinion 15*a* of the intermediate wheel 15.

The minute hand wheel 17, which is the second wheel, meshes and rotates with the pinion 16*a* of the third wheel 16, thereby moving the minute hand 2, as shown in FIG. 1.

The minute hand wheel 17 includes a minute hand shaft 17*a* in a cylinder shape.

The second hand shaft 10*a* is rotatably inserted into the minute hand shaft 17*a*.

The minute hand shaft 17*a* projects upward through the base plate 12 together with the second hand shaft 10*a*, and the minute hand 2 is attached to an upper end portion of the projected minute hand shaft 17*a*.

Figure 3:
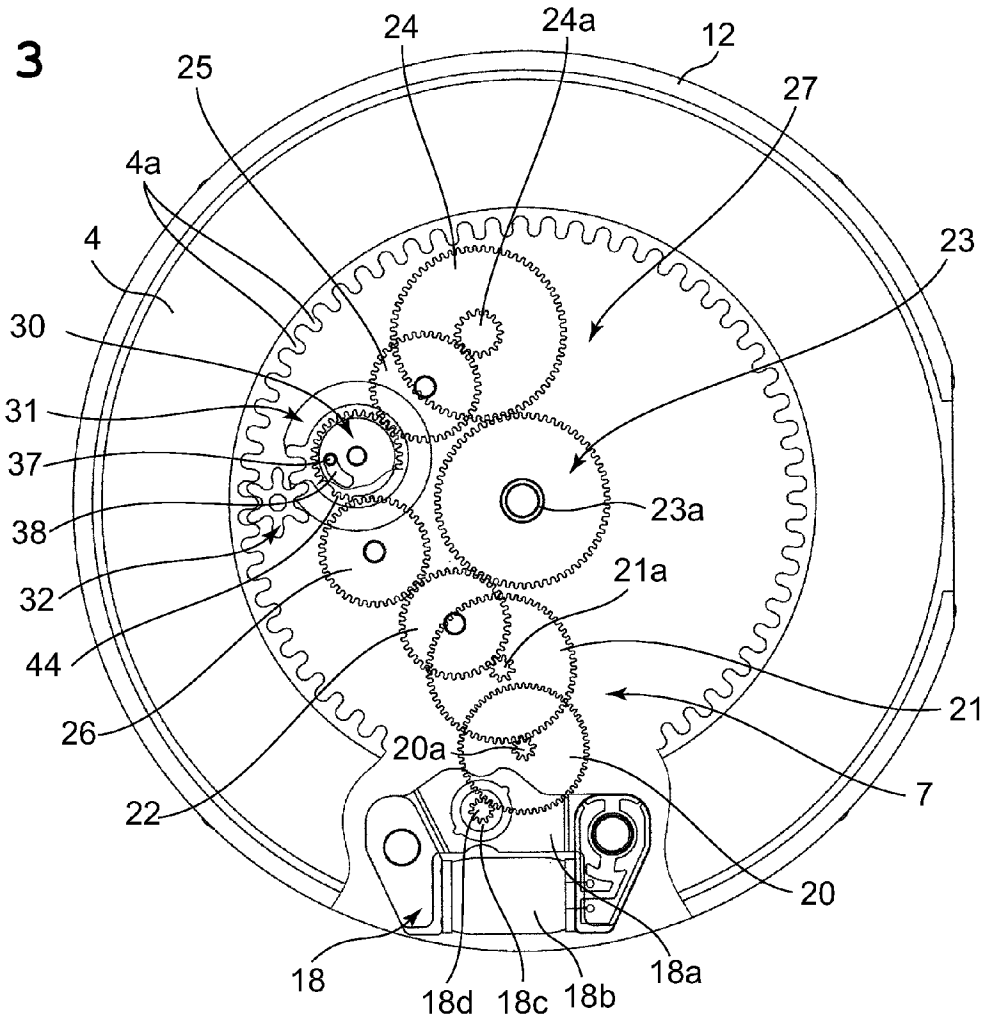
FIG. 3 is an enlarged planar view of the third drive system and the display changing device of the wristwatch shown in FIG. 2.
Figure 4:
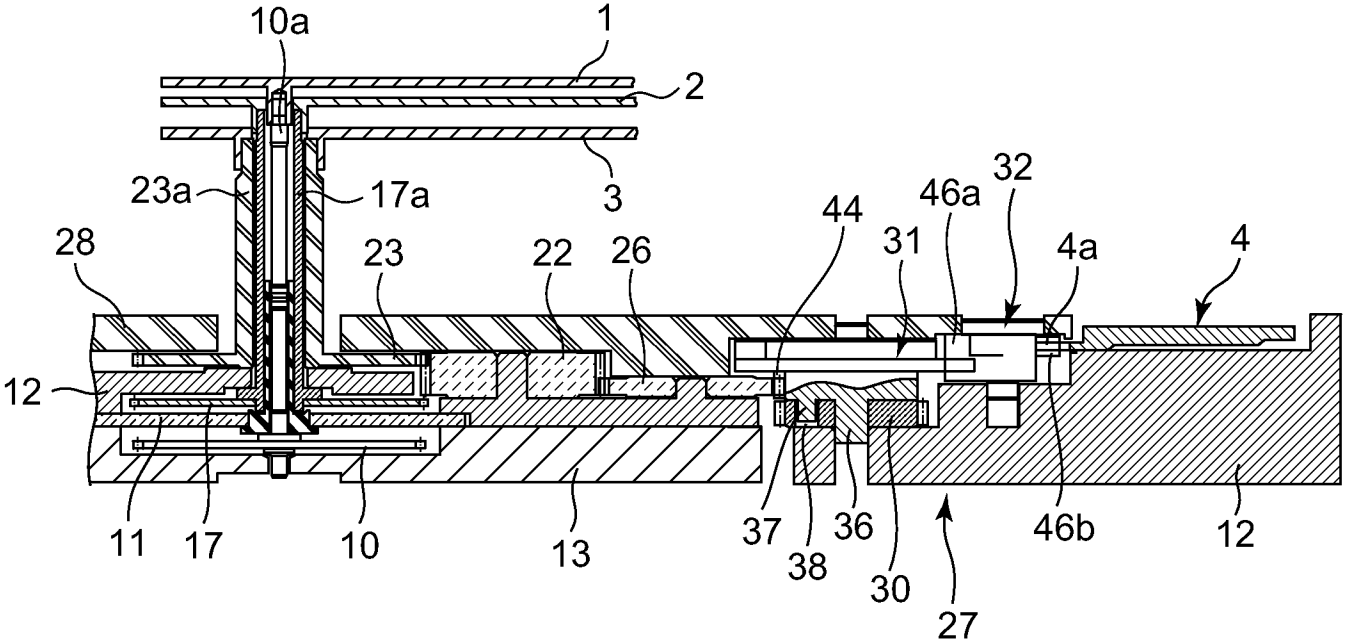
FIG. 4 is an enlarged cross-sectional view of main sections of a high speed drive system of the display changing device shown in FIG. 3.

On the other hand, the third drive system 7 comprises: a third stepper motor 18; a first intermediate wheel 20, a second intermediate wheel 21, and a third intermediate wheel 22 to which the rotation of the third stepper motor 18 is sequentially transmitted; an hour hand wheel 23, which is an hour wheel, that is rotated by the third intermediate wheel 22; a fourth intermediate wheel 24 and a fifth intermediate wheel 25 to which the rotation of the hour hand wheel 23 is sequentially transmitted; a high speed rotating wheel 26 that is rotated at high speed by the third intermediate wheel 22; and a display changing device 27 that is operated by the fifth intermediate wheel 25 and the high speed rotating wheel 26, as shown in FIG. 2 to FIG. 4.

In this structure, the third stepper motor 18 and the first intermediate wheel 20 to the third intermediate wheel 22 of the third drive system 7 are arranged between the base plate 12 and the gear train bridge 13, in a manner similar to the first drive system 5 and the second drive system 6.

The hour hand wheel 23, the fourth intermediate wheel 24, the fifth intermediate wheel 25, the high speed rotating wheel 26, and the display changing device 27 of the third drive system 7 are arranged between the base plate 12 and a pressing plate 28, as shown in FIG. 2 and FIG. 4.

The third stepper motor 18 includes: a stator 18*a*: a coil section 18*b* that is provided in the stator 18*a*; and a rotor 18*c* that is arranged within the stator 18*a*, as shown in FIG. 2 and FIG. 3.

The third stepper motor 18 is configured such that the rotor 18*c* is rotated in steps by a magnetic field generated in the stator 18*a* by the coil section 18*b*.

The first intermediate wheel 20 meshes and rotates with a rotor pinion 18*d* of the rotor 18*c* of the third stepper motor 18, as shown in FIG. 2 and FIG. 3.

The second intermediate wheel 21 meshes and rotates with a pinion 20*a* of the first intermediate wheel 20.

The third intermediate wheel 22 meshes and rotates with a pinion 21*a* of the second intermediate wheel 21.

The hour hand wheel 23, which is an hour wheel, meshes and rotates with the third intermediate wheel 22 such that the hour hand wheel 23 makes one revolution in 24 hours, thereby moving the hour hand 3, as shown in FIG. 2 and FIG. 3.

The hour hand wheel 23 includes an hour hand shaft 23 in a cylinder shape as shown in FIG. 1, FIG. 2 and FIG. 4.

The hour hand shaft 23 is arranged on the base plate 12 and rotatably pressed by the pressing plate 28, in a state where the minute hand shaft 17*a* is rotatably inserted into within the hour hand shaft 23*a*.

The hour hand 3 is attached to an upper end portion of the hour hand shaft 23*a*.

In addition, the fourth intermediate wheel 24 meshes and rotates with the hour hand wheel 23, as shown in FIG. 2 and FIG. 3.

The fifth intermediate wheel 25 meshes and rotates with a pinion 24*a* of the fourth intermediate wheel 24.

The high speed rotating wheel 26 meshes with the third intermediate wheel 22 and rotates at a higher speed than the fifth intermediate wheel 25, as shown in FIG. 3 and FIG. 4.

The display changing device 27 includes: a transmitting wheel 30 that is rotated by the fifth intermediate wheel 25; a ratchet wheel 31 that is rotated by the transmitting wheel 30 and the high speed rotating wheel 26; a feed wheel 32 that is intermittently rotated by the ratchet wheel 31; and a display wheel 4 that is rotated by the feed wheel 32, as shown in FIG. 2 to FIG. 4.

These components are arranged between the base plate 12 and the pressing plate 28.

The transmitting wheel 30 meshes and rotates with the fifth intermediate wheel 25 such that the transmitting wheel 30 makes one revolution in 24 hours, as shown in FIG. 2 and FIG. 3.

The transmitting wheel 30 is rotatably attached to the ratchet wheel 31 such that the ratchet wheel 31 is coaxially overlapped with the transmitting wheel 30, as shown in FIG. 2 to FIG. 4.

Figure 6A:
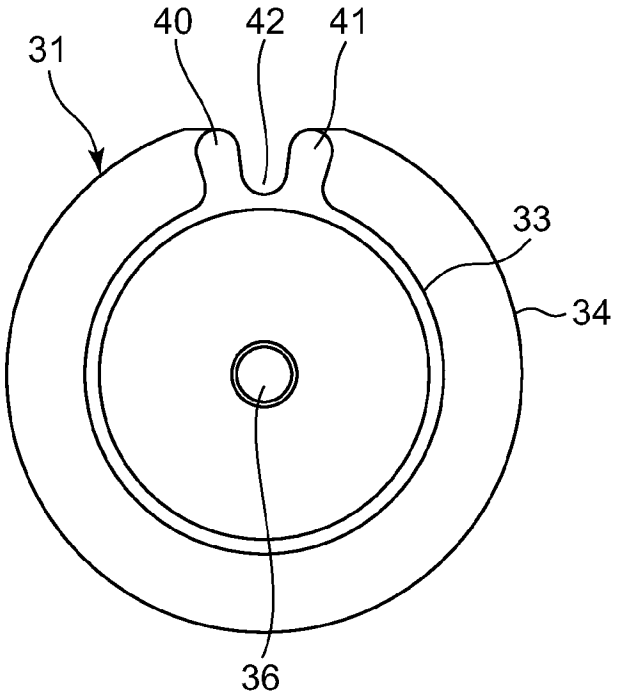
FIG. 6A is an enlarged planar view of a ratchet wheel of the display changing device shown in FIG. 3.
Figure 6B:
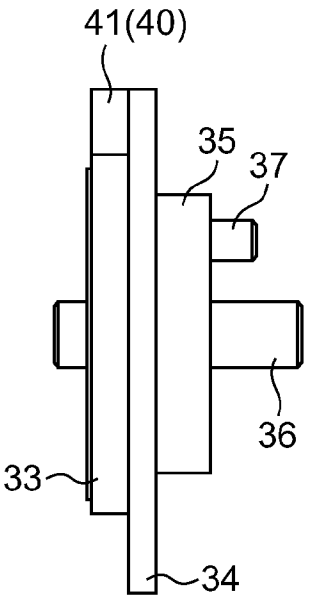
FIG. 6B is an enlarged side view of the ratchet wheel of the display changing device shown in FIG. 3.
Figure 6C:
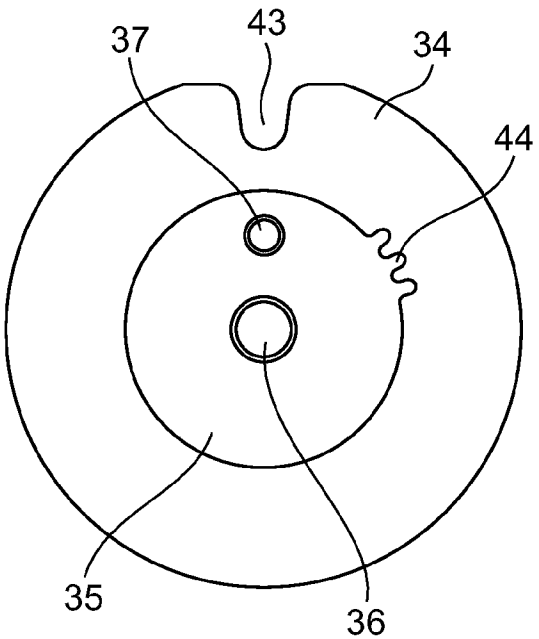
FIG. 6C is an enlarged rear view of the ratchet wheel of the display changing device shown in FIG. 3.

In other words, the ratchet wheel 31 is integrally formed with a rotation shaft 36 in a state where a first disk section 33, a second disk section 34, and a third disk section 35 are layered, as shown in FIG. 6A to FIG. 6C.

The transmitting wheel 30 is rotatably attached to the rotation shaft 36.

The rotation shaft 36 of the ratchet wheel 31 is rotatably attached to the base plate 12 and the pressing plate 28, as shown in FIG. 2 and FIG. 3.

A transmitting projection 37 (a locking section), which is a pin-shaped transmitting projection, is provided on the undersurface of the ratchet wheel 31, or in other words, the undersurface of the third disk section 35 such that the transmitting projection 37 projects downward, as shown in FIG. 2 to FIG. 6C.

Figure 5A:
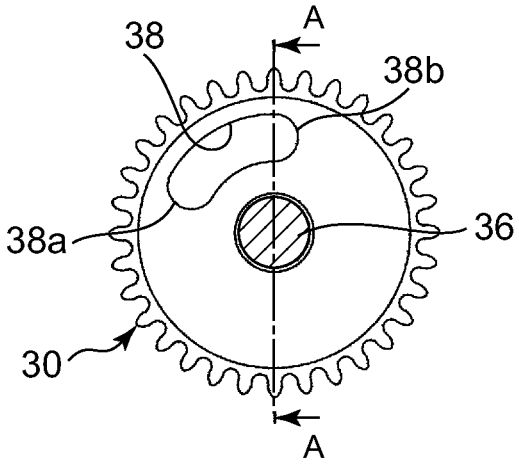
FIG. 5A is an enlarged planar view of a transmitting wheel of the display changing device shown in FIG. 3.
Figure 5B:
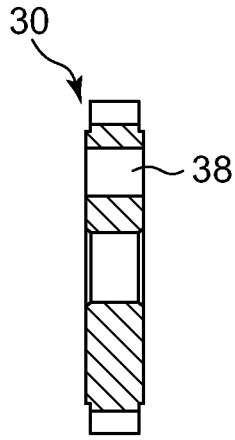
FIG. 5B is an enlarged cross-sectional view of the transmitting wheel of the display changing device shown in FIG. 3, taken along line A-A.

In this structure, a elongated hole 38 (an engaging section), which is an arc-shaped elongated hole, is provided in the transmitting wheel 30 penetrating between the front and rear sides thereof such that the transmitting projection 37 is movably inserted to the elongated hole 38, as shown in FIG. 5A and FIG. 5B.

The elongated hole 38 of the transmitting wheel 30 is provided along the circumferential direction, more specifically, along an arc the center of which is the rotation shaft 36 of the ratchet wheel 31 that is positioned in the rotational center of the transmitting wheel 30, as shown in FIG. 5A and FIG. 5B.

Figure 8B:
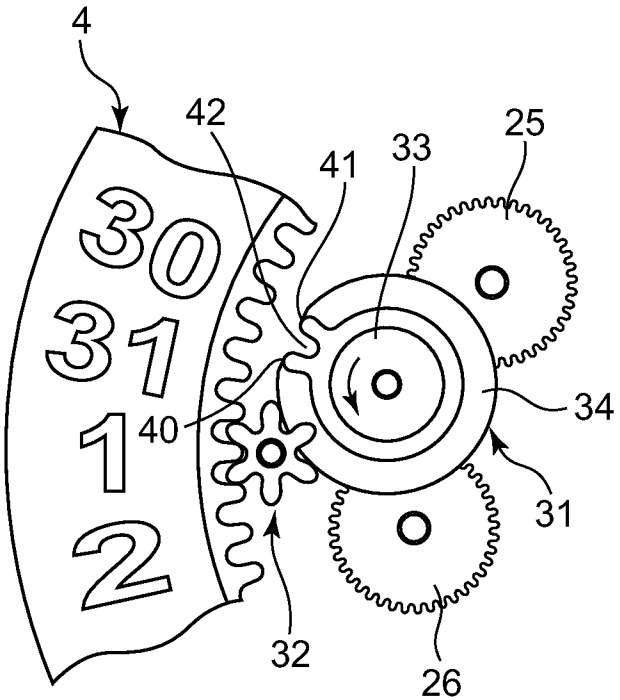
FIG. 8B is an enlarged planar view of main sections of the display changing device shown in FIG. 3, in a state where feed teeth of the ratchet wheel are moving toward the feed wheel during normal movement of the hands.
Figure 8A:
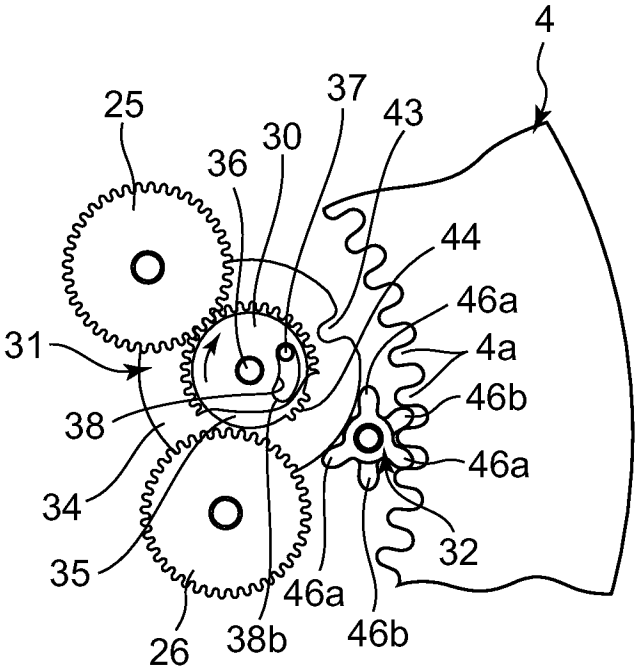
FIG. 8A is an enlarged rear view of main sections of the display changing device shown in FIG. 3, in a state where feed teeth of the ratchet wheel are moving toward the feed wheel during normal movement of the hands.

As a result, the transmitting projection 37 of the ratchet wheel 31 is placed in contact with one end section 38*a*, where both end sections 38*a* and 38*b* is positioned in the longitudinal direction of the elongated hole 38, and the end section 38*a* is positioned on the opposite side of the rotation direction of the transmitting wheel 30 as shown in FIG. 3 and FIG. 8A.

In this state, the ratchet wheel 31 rotates around the rotation shaft 36 in response to the rotation of the transmitting wheel 30.

In addition, two feed teeth 40 and 41 are provided on an outer peripheral portion of the first disk section 33 of the ratchet wheel 31 such that the two feed teeth 40 and 41 outwardly project in the radial direction. A first groove section 42 is provided between the two feed teeth 40 and 41, as shown in FIG. 6A.

The second disk section 34 is formed such that the outer diameter of the second disk section 34 is substantially the same as the diameter of the addendum circle of the two feed teeth 40 and 41 of the first disk section 33, as shown in FIG. 6A to FIG. 6C.

A second groove section 43 is provided in an outer peripheral portion of the second disk section 34 such that the second groove section 43 corresponds to the first groove section 42 of the first disk section 33.

In addition, the third disk section 35 of the ratchet wheel 31 is formed such that the outer diameter of the third disk section 35 is substantially the same as that of the transmitting wheel 30. A portion of teeth 44 are partly formed in an outer peripheral portion of the third disk section 35.

The portion of teeth 44 of the third disk section 35 mesh with the high speed rotating wheel 26 and rotate the ratchet wheel 31 at high speed, as shown in FIG. 3 and FIG. 6C.

In other words, the portion of teeth 44 of the third disk section 35 mesh with the high speed rotating wheel 26 only while the feed wheel 32 is meshing and rotating with the two feed teeth 40 and 41 of the ratchet wheel 31, as shown in FIG. 3 and FIG. 6C.

In this structure, the portion of teeth 44 of the third disk section 26 are formed substantially as long as the elongated hole 38 of the transmitting wheel 30, and located slightly away from the two feed teeth 40 and 41 of the first disk section 33 and the second groove section 43 of the second disk section 34, as shown in FIG. 6A to FIG. 6C.

Accordingly, the portion of teeth 44 of the third disk section 35 mesh with the high speed rotating wheel 26 only while the transmitting projection 37 of the ratchet wheel 31 is moving within the elongated hole 38 of the transmitting wheel 30, as shown in FIG. 3 and FIG. 6C.

As a result, when the two feed teeth 40 and 41 mesh with the feed wheel 32, the portion of teeth 44 of the third disk section 35 meshes with the high speed rotating wheel 26 and the ratchet wheel 31 is rotated at high speed by the high speed rotating wheel 26.

On the other hand, when the ratchet wheel 31 rotates the display wheel 4 to make one revolution in 24 hours in a state where the feed wheel 32 is located close to the outer peripheral surface of the ratchet wheel 31 and the ratchet wheel 31 rotates, the feed wheel 32 is intermittently rotated by a predetermined angle by the two feed teeth 40 and 41 of the ratchet wheel 31, as shown in FIG. 2.

Figure 7A:
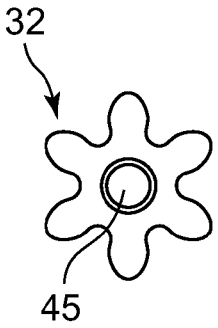
FIG. 7A is an enlarged planar view of a feed wheel of the display changing device shown in FIG. 3.
Figure 7B:
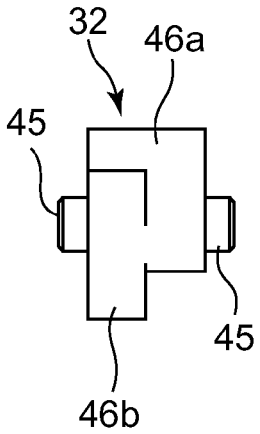
FIG. 7B is an enlarged side view of the feed wheel of the display changing device shown in FIG. 3.
Figure 7C:
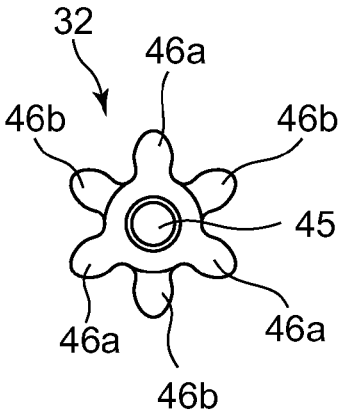
FIG. 7C is an enlarged rear view of the feed wheel of the display changing device shown in FIG. 3.

A rotation shaft 45 is provided in the center portion of the feed wheel 32 such that the rotation shaft 45 projects in the up/down direction, as shown in FIG. 7A to FIG. 7C.

Tooth sections 46*a* and tooth sections 46*b* (a plurality of tooth sections) are provided in the outer periphery of the feed wheel 32 to mesh with the two feed teeth 40 and 41 of the ratchet wheel 31 and inner teeth 4*a* of the display wheel 4.

The tooth sections 46*a* and the tooth sections 46*b* (a plurality of tooth sections) consists of six tooth sections in total, and are configured to alternately form the tooth section 46*a* having a thick face width (hereinafter referred to as "thick tooth section 46*a*") and the tooth section 46*b* having a thin face width (hereinafter referred to as "thin tooth section 46*b*"), as shown in FIG. 7A to FIG. 7C.

In this structure, the three thick tooth sections 46*a* are formed such that the thickness of the three thick tooth sections 46*a* becomes substantially the same as the combined thickness of the first disk section 33 and the second disk section 34 of the ratchet wheel 31.

The three thin tooth sections 46*b* are formed such that the thickness of the three thin tooth sections 46*b* becomes substantially the same as or slightly thinner than that of the first disk section 33 of the ratchet wheel 31.

In addition, the three thick tooth sections 46*a* are meshed with the first groove section 42 and the second groove section 43 of the ratchet wheel 31. When unmeshed, the thick tooth sections 46*a* relatively move along the outer peripheral surface of the second disk section 34 while coming in contact with the outer peripheral surface thereof.

Whereas, the three thin tooth sections 46*b* are not meshed with the first groove section 42 or the second groove section 43 of the ratchet wheel 31, and removably come into contact with either of the two feed teeth 40 and 41 of the ratchet wheel 31.

In this structure, the thin tooth sections 46*b* are configured such that, when two thick tooth sections 46*a* among the three thick tooth sections 46*a* relatively move along the outer peripheral surface of the second disk section 34 while coming in contact with the outer peripheral surface thereof, the one thin tooth section 46*b* positioned between the two thick tooth sections 46*a* approaches the outer peripheral surface of the first disk section 33 of the ratchet wheel 31, as shown in FIG. 3, FIG. 8A and FIG. 8B.

The thin tooth section 46*b* is then positioned on the top surface of the second disk section 34, or in other words, on a movement track of the two feed teeth 40 and 41 provided in the first disk section 33, and relatively moves on the movement track.

Figure 10B:
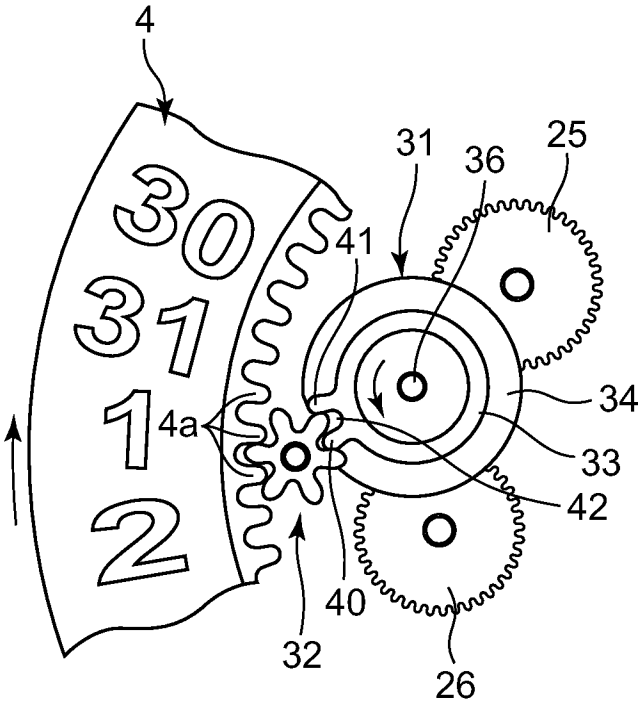
FIG. 10B is an enlarged planar view of main sections of the display changing device shown in FIG. 9B, in a state where the feed teeth of the ratchet wheel start to mesh with a thick tooth section of the feed wheel, and a portion of the teeth of the ratchet wheel beginning to mesh with a high speed rotating wheel and rotate at high speed during normal movement of the hands.
Figure 10A:
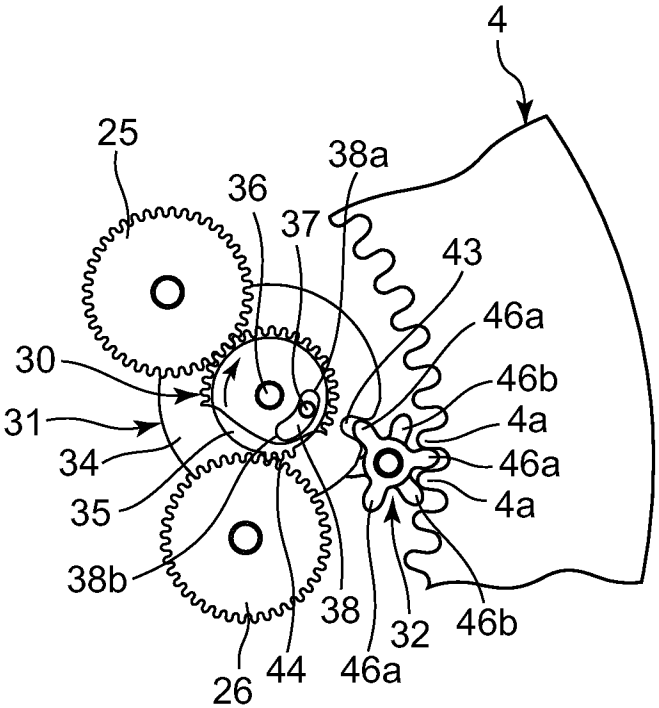
FIG. 10A is an enlarged rear view of main sections of the display changing device shown in FIG. 9A, in a state where the feed teeth of the ratchet wheel start to mesh with a thick tooth section of the feed wheel, and a portion of the teeth of the ratchet wheel beginning to mesh with a high speed rotating wheel and rotate at high speed during normal movement of the hands.

In addition, while the ratchet wheel 31 is rotating in a state where one thick tooth section 46*a* is meshed with the first groove section 42 and the second groove section 43 of the ratchet wheel 31, the thin tooth section 46*b* separates from the movement track of the two feed teeth 40 and 41 provided in the first disk section 33, thereby being positioned on the outer peripheral side of the second disk section 34, as shown in FIG. 10A and FIG. 10B.

As a result, the ratchet wheel 31 and the feed wheel 32 are configured such that, while the ratchet wheel 31 is rotating in a state where the thick tooth section 46*a* is disengaged from the first groove section 42 and the second groove section 43 of the ratchet wheel 31, the other two thick tooth sections 46*a* among the thick tooth sections 46*a* of the feed wheel 32 relatively move along the outer peripheral surface of the second disk section 34 of the ratchet wheel 31 while coming in contact with the outer peripheral surface, as shown in FIG. 8A and FIG. 8B.

As a result, the rotation of the feed wheel 32 is restricted and stopped.

In addition, the ratchet wheel 31 and the feed wheel 32 are configured such that, while the ratchet wheel 31 is rotating in a state where the one thick tooth section 46*a* among the three thick tooth sections 46*a* is meshed with the first groove section 42 and the second groove section 43 of the ratchet wheel 31, the other thick tooth sections 46*a* that are not meshed with the first groove section 42 and the second groove section 43 move away from the outer peripheral surface of the second disk section 34 of the ratchet wheel 31, as shown in FIG. 10A and FIG. 10B.

As a result, the rotation restriction on the feed wheel 32 is released.

In addition, the ratchet wheel 31 and the feed wheel 32 are configured as follows; the ratchet wheel 31 rotates in a state where the two thick tooth sections 46*a* among the thick tooth sections 46*a* of the feed wheel 32 are in contact with the outer peripheral surface of the second disk section 34 of the ratchet wheel 31 and the rotation of the feed wheel 32 is restricted. When one feed tooth 40 positioned in the rotation direction side of the two feed teeth 40 and 41 of the ratchet wheel 31 comes into contact with the thin tooth section 46*b* of the feed wheel 32 positioned in the rotation direction side, the thick tooth section 46*a* of the feed wheel 32 moves into the first groove section 42 and the second groove section 43 of the ratchet wheel 31, as shown in FIG. 8A, FIG. 8B, FIG. 9A, and FIG. 9B.

As a result, the rotation restriction on the feed wheel 32 is released, and the feed wheel 32 starts rotating.

In addition, the ratchet wheel 31 and the feed wheel 32 are configured as follows: the one feed tooth 40 of the ratchet wheel 31 is inserted between the thin tooth section 46*b* of the feed wheel 32 that is in contact with the feed tooth 40 and the thick tooth section 46*a* that is adjacent thereto in response to the rotation of the ratchet wheel 31. As a result, the thick tooth section 46*a* is meshed with the first groove section 42 and the second groove section 43 of the ratchet wheel 31, as shown in FIG. 10A, FIG. 10B, FIG. 11A, and FIG. 11B.

In this state, the feed wheel 32 rotates in response to the rotation of the ratchet wheel 31.

Figure 12B:
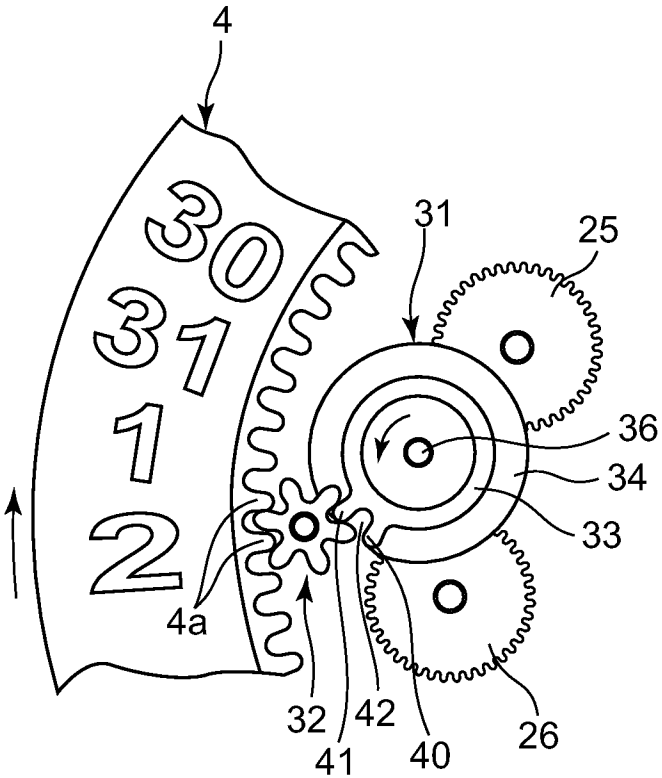
FIG. 12B is an enlarged planar view of main sections of the display changing device shown in FIG. 11B, in a state where the ratchet wheel rotates at high speed, and the thick tooth section of the feed wheel disengages from a first groove section and a second groove section of the feed teeth during normal movement of the hands.
Figure 12A:
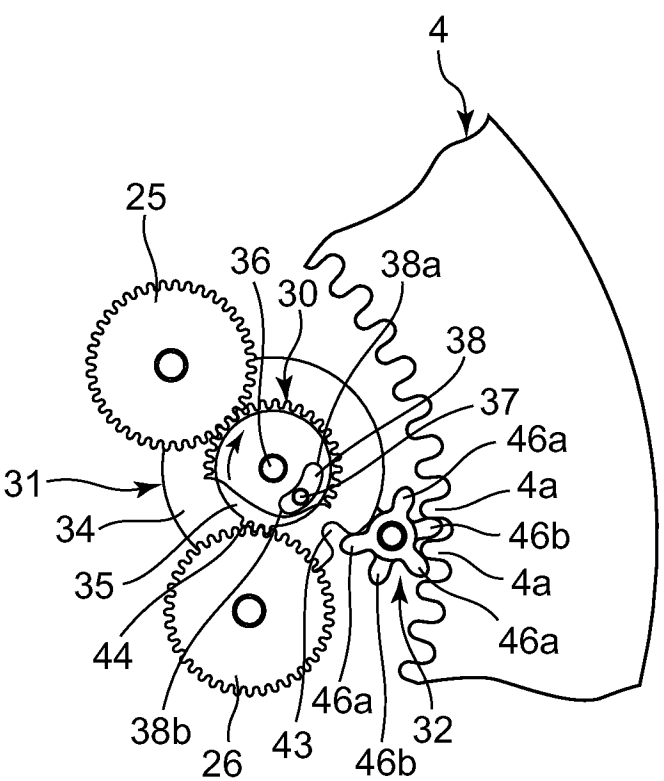
FIG. 12A is an enlarged rear view of main sections of the display changing device shown in FIG. 11A, in a state where the ratchet wheel rotates at high speed, and the thick tooth section of the feed wheel disengages from a first groove section and a second groove section of the feed teeth during normal movement of the hands.

In addition, the ratchet wheel 31 and the feed wheel 32 are configured such that, when the one thick tooth section 46*a* of the feed wheel 32 disengages from the first groove section 42 and the second groove section 43 of the ratchet wheel 31, the other feed tooth 41 that is positioned on the opposite side of the rotation direction of the ratchet wheel 31 is inserted between the thick tooth section 46*a* of the feed wheel 32 that is positioned within the first groove section 42 and the second groove section 43 of the ratchet wheel 31 and the adjacent thin tooth section 46*b* that is positioned on the opposite side of the rotation direction, as shown in FIG. 12A and FIG. 12B.

The ratchet wheel 31 and the feed wheel 32 are configured such that the thin tooth section 46*b* is positioned on the top surface of the second disk section 34, or in other words, on the movement track of the two feed teeth 40 and 41 of the first disk section 33 and relatively moves on the movement track, while approaching the outer peripheral surface of the first disk section 33 of the ratchet wheel 31.

Figure 13B:
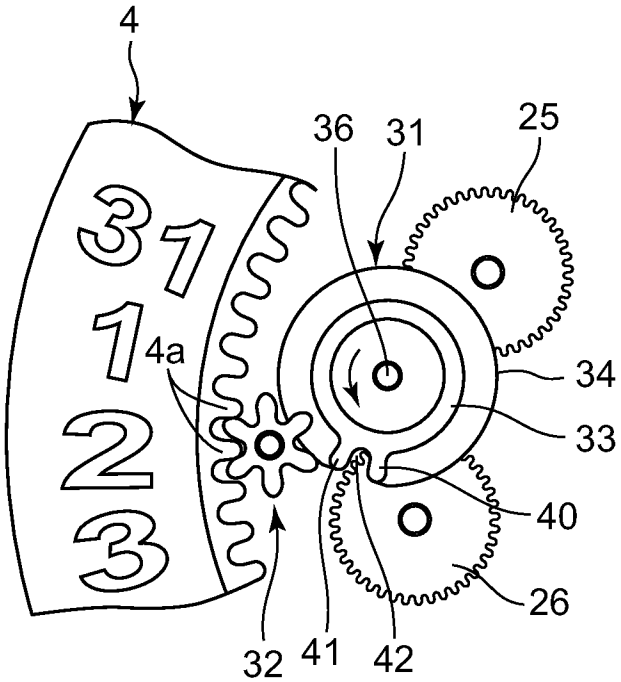
FIG. 13B is an enlarged rear view of main sections of the display changing device shown in FIG. 12B, in a state where the ratchet wheel is unmeshed with the feed wheel, and the portion of teeth of the ratchet wheel moves away from the high speed rotating wheel, whereby the high speed rotation of the display wheel is completed during normal movement of the hands.
Figure 13A:
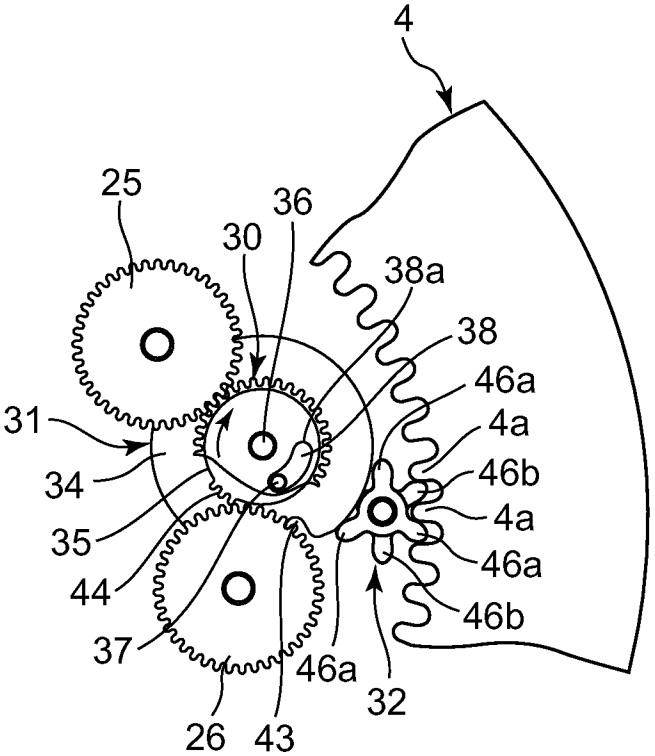
FIG. 13A is an enlarged rear view of main sections of the display changing device shown in FIG. 12A, in a state where the ratchet wheel is unmeshed with the feed wheel, and the portion of teeth of the ratchet wheel moves away from the high speed rotating wheel, whereby the high speed rotation of the display wheel is completed during normal movement of the hands.

Furthermore, the ratchet wheel 31 and the feed wheel 32 are configured as follows: the one thick tooth section 46*a* of the feed wheel 32 disengages from the first groove section 42 and the second groove section 43 of the ratchet wheel 31, and the thin tooth section 46*b* that is adjacent to the disengaged thick tooth section 46*a* and that is positioned on the opposite side of the rotation direction approaches the outer peripheral surface of the first disk section 33 while moving on the top surface of the second disk section 34 of the ratchet wheel 31, as shown in FIG. 13A and FIG. 13B.

The ratchet wheel 31 and the feed wheel 32 are configured to be movably positioned on the movement track of the feed teeth 40 and 41 of the first disk section 33 of the ratchet wheel 31.

The ratchet wheel 31 and the feed wheel 32 are configured such that, when the thin tooth section 46*b* that is adjacent to the disengaged thick tooth section 46*a* and that is positioned on the opposite side of the rotation direction is positioned on the movement track of the two feed teeth 40 and 41 of the first disk section 33 of the ratchet wheel 31, the other two thick tooth sections 46*a* of the feed wheel 32 relatively move along the outer peripheral surface of the second disk section 34 of the ratchet wheel 31 while coming in contact with the outer peripheral surface thereof, as shown in FIG. 13A and FIG. 13B.

As a result, the rotation of the feed wheel 32 is restricted and stopped, and the feed wheel 32 does not rotate even when the ratchet wheel 31 rotates.

By the way, the display wheel 4 is a date wheel that is formed into a flat ring shape, as shown in FIG. 3.

Date displays from the 1st to the 31st are displayed at equal intervals on the surface of the display wheel 4. The inner teeth 4*a* are provided on an inner peripheral portion of the display wheel 4. The tooth sections 46*a* and 46*b* of the feed wheel 32 sequentially mesh with the inner teeth 4*a*.

As a result, the display wheel 4 rotates in response to the intermittent rotation of the feed wheel 32, and the date display changes every 24 hours.

In this structure, the display wheel 4 is configured such that, when the date display is changed, the high speed rotating wheel 26 meshes with the portion of teeth 44 of the third disk section 35 of the ratchet wheel 31. As a result, the ratchet wheel 31 rotates at high speed, and the feed wheel 32 rotates at high speed by the high speed rotation of the ratchet wheel 31, whereby the date display is quickly changed, as shown in FIG. 9A to FIG. 12B.

Next, the mechanism of the above-described pointer type wristwatch will be described.

In the wristwatch, the first stepper motor 8, the second stepper motor 14, and the third stepper motor 18 rotate, whereby the second hand 1, the minute hand 2, and the hour hand 3 are respectively moved by the rotation of the motors. As a result, the time is indicated.

In this structure, the rotation of the third stepper motor 18 is transmitted to the hour hand wheel 23 by the first intermediate wheel 20, the second intermediate wheel 21, and the third intermediate wheel 22. As a result, the hour hand wheel 23 rotates, and the hour hand 3 moves as normal such that the hour hand 3 makes one revolution in 24 hours.

At this time, the fourth intermediate wheel 24 and the fifth intermediate wheel 25 rotate in response to the rotation of the hour hand wheel 23. Then, the transmitting wheel 30 of the display changing device 27 is rotated by the rotation of the fifth intermediate wheel 25. And then, the ratchet wheel 31 is rotated at a slow speed, such that the ratchet wheel 31 makes one revolution in 24 hours by the rotation of the transmitting wheel 30.

As a result, the two feed teeth 40 and 41 of the ratchet wheel 31 approach the feed wheel 32, and the portion of teeth 44 of the ratchet wheel 31 approach the high speed rotating wheel 26.

At this time, the feed wheel 32 does not rotate, and whereby the display wheel 4 is not also rotated because the two feed teeth 40 and 41 of the ratchet wheel 31 are not meshed with the feed wheel 32.

At this time, the high speed rotating wheel 26 is rotated at a high speed, such that the high speed rotating wheel 26 makes several rotations in 24 hours, by the rotation of the third intermediate wheel 22 that rotates the hour hand wheel 23 and moves the hour hand 3. However, the ratchet wheel 31 does not rotate even when the high speed rotating wheel 26 rotates at high speed. It is because the high speed rotating wheel 26 is not meshed with the portion of teeth 44 of the third disk section 35 of the ratchet wheel 31.

In this state, when the ratchet wheel 31 is further rotated slowly by the rotation of the transmitting wheel 30, the two feed teeth 40 and 41 of the ratchet wheel 31 approach the feed wheel 32 and start to mesh, whereby the portion of teeth 44 of the ratchet wheel 31 approaches the high speed rotating wheel 26 and starts to mesh.

Then, the ratchet wheel 31 is rotated at high speed by the high speed rotation of the high speed rotating wheel 26. As a result, the two feed teeth 40 and 41 of the ratchet wheel 31 mesh with the feed wheel 32, and rotate the feed wheel 32 at high speed, whereby the display wheel 4 is rotated. Therefore, the date display of the display wheel 4 is quickly changed.

When the ratchet wheel 31 is rotated at high speed by the high speed rotation of the high speed rotating wheel 26 and the date display of the display wheel 4 is changed, the transmitting projection 37 of the ratchet wheel 31 moves from one end section 38*a* to the other end section 38*b* within the elongated hole 38 of the transmitting wheel 30 at a higher speed than the rotation speed of the transmitting wheel 30, while the hour hand 3 is moving as normal.

After the date display of the display wheel 4 is changed, the portion of teeth 44 of the ratchet wheel 31 and the high speed rotating wheel 26 are unmeshed, and the rotation of the ratchet wheel 31 is temporarily stopped.

At this time, since the transmitting projecting section 37 of the ratchet wheel 31 is only relatively moving within the elongated hole 38 of the transmitting wheel 30, the ratchet wheel 31 does not rotate even when the transmitting wheel 30 is rotated by the fifth intermediate wheel 25. This is because the transmitting projection 37 of the ratchet wheel 31 is approaching the other end section 38*b* of the elongated hole 38 of the transmitting wheel 30, whereby the rotation of the high speed rotating wheel 26 to the ratchet wheel 31 is stopped.

When the transmitting projection 37 of the ratchet wheel 31 comes into contact with the one end section 38*a* of the elongated hole 38 of the transmitting wheel 30, the ratchet wheel 31 once again slowly rotates at a speed at which one revolution is made in 24 hours, and then prepares for the next change in date display.

Operations of the above-described display change device 27 in the pointer type wristwatch will hereinafter be described in detail with reference to FIG. 8 to FIG. 13A and FIG. 13B.

In a state before the date display of the display wheel 4 is changed, the transmitting projection 37 of the ratchet wheel 31 is in contact with the one end section 38*a* positioned in the rotation direction side of the elongated hole 38 of the transmitting wheel 30, as shown in FIG. 8A and FIG. 8B.

In this state, the third stepper motor 18 rotates, and the hour hand 3 is moved at a normal speed at which one revolution is made in 24 hours. In addition, the transmitting wheel 30 is rotated in the direction of the arrow (clockwise in FIG. 8A) at a speed at which one revolution is made in 24 hours, and rotates the ratchet wheel 31.

At this time, in a state where the thick tooth sections 46*a* of the feed wheel 32 are disengaged from the first groove section 42 and the second groove section 43 of the ratchet wheel 31, two thick tooth sections 46*a* among the three thick tooth sections 46*a* of the feed wheel 32 are in contact with the outer peripheral surface of the second disk section 34 of the ratchet wheel 31, as shown in FIG. 8A.

In addition, the other one thick tooth section 46*a* is meshed with the inner teeth 4*a* of the display wheel 4.

In this state, the two thick tooth sections 46*a* of the feed wheel 32 that are in contact with the outer peripheral surface of the second disk section 34 of the ratchet wheel 31 relatively move along the outer peripheral surface of the second disk section 34 of the ratchet wheel 31.

As a result, the feed wheel 32 does not rotate even when the ratchet wheel 31 rotates.

Therefore, even when rotational force is applied to the display wheel 4 by unintentional external force, the display wheel 4 does not rotate, whereby the date display does not accidentally change.

In addition, at this time, one thin tooth section 46*b* of the feed wheel 32 positioned in the rotation direction side of the ratchet wheel 31 is positioned on the top surface of the second disk section 34, or in other words, on the movement track of the two feed teeth 40 and 41 provided in the first disk section 33 and relatively moves on the movement track, in a state where the one thin tooth section 46*b* approaches the outer peripheral surface of the first disk section 33 of the ratchet wheel 31, as shown in FIG. 8B.

In addition, one thin tooth section 46*b* of the other thin tooth sections 46*b* is meshed with the inner teeth 4*a* of the display wheel 4.

Figure 9B:
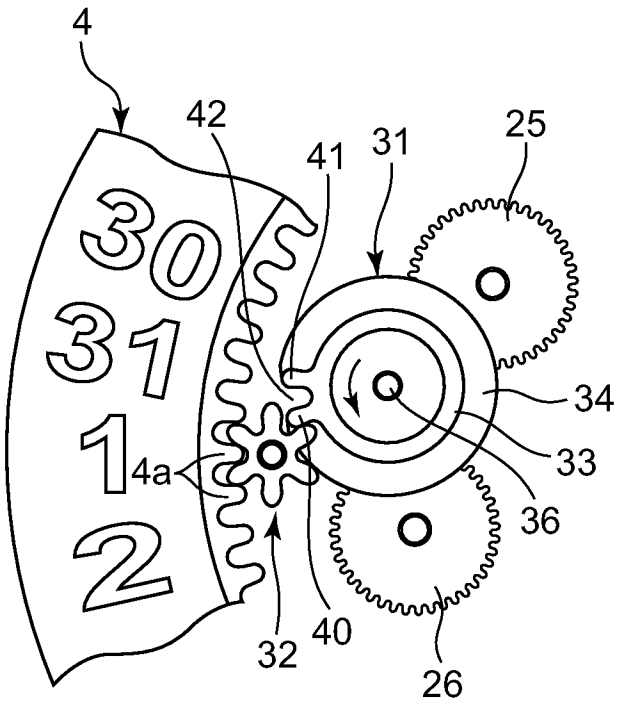
FIG. 9B is an enlarged planar view of main sections of the display changing device shown in FIG. 8B, in a state where the feed teeth of the ratchet wheel approach a thin tooth section of the feed wheel during normal movement of the hands.
Figure 9A:
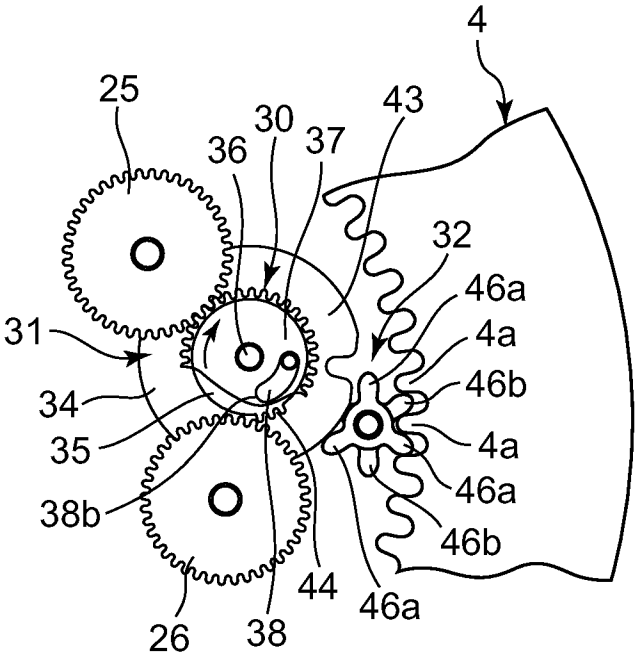
FIG. 9A is an enlarged rear view of main sections of the display changing device shown in FIG. 8A, in a state where the feed teeth of the ratchet wheel approach a thin tooth section of the feed wheel during normal movement of the hands.

In this state, when the ratchet wheel 31 rotates and the hour hand 3 approaches 24 hours, one feed tooth 40 positioned in the rotation direction side of the two feed teeth 40 and 41 of the ratchet wheel 31 comes into contact with one thin tooth section 46*b* of the feed wheel 32 positioned in the rotation direction side, as shown in FIG. 9A and FIG. 9B.

At this time, the portion of teeth 44 of the third disk section 35 of the ratchet wheel 31 approaches the high speed rotating wheel 26 and starts to mesh.

Then, the ratchet wheel 31 is rotated at high speed by the high speed rotating wheel 26 while the hour hand 3 is moving as normal by the rotation of the third stepper motor 18.

At this time, one feed tooth 40 positioned in the rotation direction side of the two feed teeth 40 and 41 of the ratchet wheel 31 is in contact with the one thin tooth section 46*b* of the feed wheel 32 positioned in the rotation direction side, as shown in FIG. 10A and FIG. 10B.

As a result, the one thick tooth section 46*a* of the feed wheel 32 positioned on the opposite side of the rotation direction of the ratchet wheel 31 moves into the first groove section 42 and the second groove section 43 positioned between the two feed teeth 40 and 41 of the ratchet wheel 31.

At this time, of the two thick tooth sections 46*a* of the feed wheel 32 that are in contact with the outer peripheral surface of the second disk section 34 of the ratchet wheel 31, the thick tooth section 46*a* positioned on the opposite side of the rotation direction of the ratchet wheel 31 moves into the first groove section 42 and the second groove section 43 positioned between the two feed teeth 40 and 41 of the ratchet wheel 31, as shown in FIG. 10A.

In addition, a thick tooth section 46*a* of the feed wheel 32 positioned in the rotation direction side gradually moves away from the outer peripheral surface of the second disk section 34 of the ratchet wheel 31.

As a result, the rotation restriction on the feed wheel 32 is released and the feed wheel 32 starts to rotate, whereby the display wheel 4 also starts to rotate.

In addition, at this time, the transmitting projection 37 of the ratchet wheel 31 starts to move within the elongated hole 38 of the transmitting wheel 30, from one end section 38*a* to the other end section 38*b*, as shown in FIG. 10A. It is because the ratchet wheel 31 is rotated at a higher speed than the transmitting wheel 30 by the high speed rotating wheel 26.

Figure 11B:
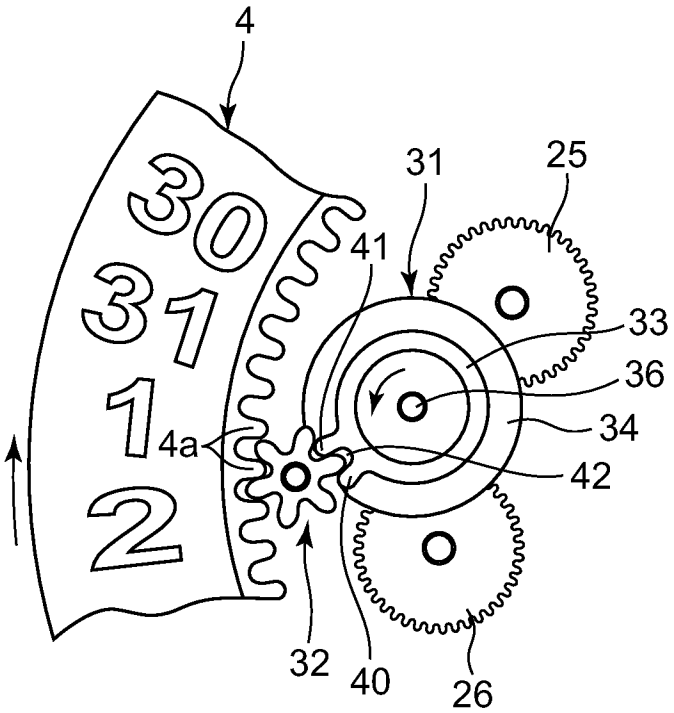
FIG. 11B is an enlarged planar view of main sections of the display changing device shown in FIG. 10B, in a state where the ratchet wheel rotates the feed wheel at high speed by the high speed rotating wheel, and the display wheel is accordingly rotated at high speed, whereby date display is in the midst of changing during normal movement of the hands.
Figure 11A:
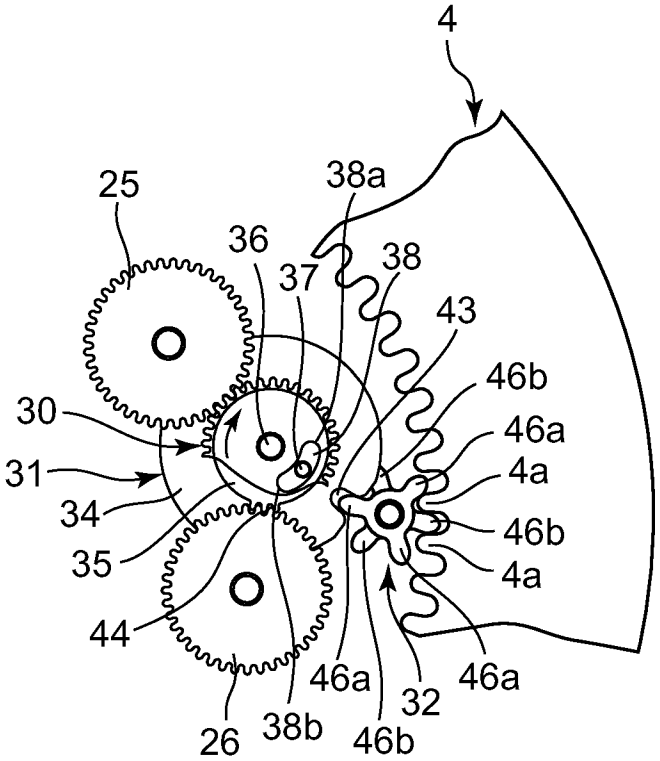
FIG. 11A is an enlarged rear view of main sections of the display changing device shown in FIG. 10A, in a state where the ratchet wheel rotates the feed wheel at high speed by the high speed rotating wheel, and the display wheel is accordingly rotated at high speed, whereby date display is in the midst of changing during normal movement of the hands.

Then, the ratchet wheel 31 is further rotated at high speed, and the one feed tooth 40 positioned in the rotation direction side of the ratchet wheel 31 is inserted between the thin tooth section 46*b* of the feed wheel 32 that is in contact with the one feed tooth 40 and the adjacent thick tooth section 46*a* that is positioned on the opposite side of the rotation direction, as shown in FIG. 11A and FIG. 11B.

Then, the thick tooth section 46*a* is meshed with the first groove section 42 and the second groove section 43 of the ratchet wheel 31.

At this time, the thin tooth section 46*b* of the feed wheel 32 that is in contact with the one feed tooth 40 gradually moves away from the outer peripheral surface of the first disk section 33, and a thin tooth section 46*b* of the feed wheel 32 that is positioned on the opposite side of the rotation direction gradually approaches the other feed tooth 41 positioned on the opposite side of the rotation direction of the ratchet wheel 31.

As a result, the feed wheel 32 is further rotated at high speed, whereby the display wheel 4 is also further rotated at high speed.

At this time, the ratchet wheel 31 is rotated at a higher speed than the transmitting wheel 30, while the hour hand 3 is moving at a normal speed at which one revolution is made in 24 hours by the rotation of the third stepper motor 18. As a result, the transmitting projection 37 of the ratchet wheel 31 further moves within the elongated hole 38 of the transmitting wheel 30, from one end section 38*a* to the other end section 38*b*.

Then, the ratchet wheel 31 is further rotated at high speed. When the thick tooth section 46*a* of the feed wheel 32 disengages from the first groove section 42 and the second groove section 43 of the ratchet wheel 31, the other feed tooth 41 positioned on the opposite side of the rotation direction of the ratchet wheel 31 is gradually inserted between the thick tooth section 46*a* of the feed wheel 32 that is positioned within the first groove section 42 and the second groove section 43 of the ratchet wheel 31 and the adjacent thin tooth section 46*b* that is positioned on the opposite side of the rotation direction, as shown in FIG. 12A and FIG. 12B.

At this time, the thin tooth section 46*b* that is adjacent to the other feed tooth 41 and that is positioned on the opposite side of the rotation direction of the ratchet wheel 31 approaches the outer peripheral surface of the first disk section 33 while moving on the top surface of the second disks section 34 of the ratchet wheel 31, as shown in FIG. 12A and FIG. 12B.

The thin tooth section 46*b* is positioned on the movement track of the two feed teeth 40 and 41 of the first disk section 33.

At this time as well, the feed wheel 32 is further rotated, whereby the display wheel 4 is further rotate.

In this state, when the ratchet wheel 31 is further rotated at high speed, the feed wheel 32 is further rotated, thereby further rotating the display wheel 4. As a result, the date display of the display wheel 4 is completely changed, as shown in FIG. 13A and FIG. 13B.

At this time, the ratchet wheel 31 rotates at a higher speed than the transmitting wheel 30. As a result, the transmitting projection 37 of the ratchet wheel 31 moves within the elongated hole 38 of the transmitting wheel 30 and approaches the other end section 38*b*. Then, the portion of teeth 44 of the ratchet wheel 31 moves away from the high speed rotating wheel 26, and then the portion of teeth 44 of the ratchet wheel 31 and the high speed rotating wheel 26 are unmeshed, whereby the high speed rotation of the ratchet wheel 31 is stopped.

In addition, at this time, the one thick tooth section 46*a* of the feed wheel 32 is disengaged from the first groove section 42 and the second groove section 43 of the ratchet wheel 31. The disengaged thick tooth section 46*a* and the thick tooth section 46*a* positioned on the opposite side of the rotation direction come into contact with the outer peripheral surface of the second disk section 34 of the ratchet wheel 31.

At this time as well, the two thick tooth sections 46*a* of the feed wheel 32 that are in contact with the outer peripheral surface of the second disk section 34 of the ratchet wheel 31 relatively move along the outer peripheral surface of the second disk section 34 of the ratchet wheel 31, as shown in FIG. 13B.

In this state, the rotation of the feed wheel 32 is restricted. Accordingly, the feed wheel 32 does not rotate even when the ratchet wheel 31 rotates.

As a result, even when rotational force is applied to the display wheel 4 by unintentional external force, the display wheel 4 does not rotate, whereby the date display does not arbitrarily change.

In addition, in this state, the one thin tooth section 46*b* of the ratchet wheel 31 is positioned on the movement track of the two feed teeth 41 and 42 of the first disk section 26 positioned on the top surface of the second disk section 27 and relatively moves on the movement locus, while being made to approach the outer peripheral surface of the first disk section 26 of the ratchet wheel 31, as shown in FIG. 13A.

Then, the transmitting wheel 30 is slowly rotated by the fifth intermediate wheel 25 at a speed at which one revolution is made in 24 hours, while the hour hand 3 is being moved at a normal speed at which one revolution is made in 24 hours by the rotation of the third stepper motor 18.

At this time, the transmitting projection 37 of the ratchet wheel 31 relatively moves within the elongated hole 38 of the transmitting wheel 30, from the other end section 38*b* to the one end section 38*a*. As a result, the ratchet wheel 31 does not rotate.

When the transmitting projection 37 of the ratchet wheel 31 comes into contact with the one end section 38*a* of the elongated hole 38 of the transmitting wheel 30, the ratchet wheel 31 once again slowly starts to rotate at a speed at which one revolution is made in 24 hours by the transmitting wheel 30, and then prepares for the next change in date display.

As described above, the pointer type wristwatch includes: the transmitting wheel 30 that is rotated by the rotation of the third stepper motor 18 that moves the hour hand 3; the ratchet wheel 31 that is rotatably provided in a state where the ratchet wheel 31 is coaxially overlapped with the transmitting wheel 30; the feed wheel 31 that is intermittently rotated by a predetermined angle for each one revolution of the ratchet wheel 31; the display wheel 4 that is rotated by the rotation of the feed wheel 32, whereby date display is changed; and the high speed rotating wheel 26 that is rotated at a higher speed than the transmitting wheel 30 by the rotation of the third stepper motor 18. The portion of teeth 44 of the ratchet wheel 31 meshes with the high speed rotating wheel 26 and rotates the ratchet wheel 31 at high speed, in a state where the transmitting projection 37 of the ratchet wheel 31 can move along the elongated hole 38 of the transmitting wheel 30. Therefore, the date display can be quickly changed while the hour hand 3 is moving as normal.

In other words, in the pointer type wristwatch, the ratchet wheel 31 can be rotated by the rotation of the transmitting wheel 30, and whereby the feed teeth 40 and 41 provided in a portion of the outer peripheral portion of the ratchet wheel 31 can be made to approach the feed wheel 32, while the hour hand 3 is being moved as normal by the rotation of the third stepper motor 18.

In addition, the portion of teeth 44 partly provided in the outer peripheral portion of the ratchet wheel 31 can be made to approach the high speed rotating wheel 26.

In this state, when the date display of the display wheel 4 is changed, the portion of teeth 44 of the ratchet wheel 31 can be meshed with the high speed rotating wheel 26. As a result, the ratchet wheel 31 can be rotated at high speed while the transmitting projection 37 of the ratchet wheel 31 is being moved along within the elongated hole 38 of the transmitting wheel 30 by the high speed rotation of the high speed rotating wheel 26.

Accordingly, and the date display of the display wheel 4 can be quickly changed by the feed wheel 32 being rotated at high speed.

Therefore, the date display can be quickly changed while the hour hand 3 is moving as normal.

In this structure, the transmitting projection 37 is a pin-shaped projection formed in the ratchet wheel 31 such that the transmitting projection 37 projects toward the transmitting wheel 30. The elongated hole 38 is an arc-shaped elongated hole 38 formed in the transmitting wheel 30 such that the transmitting projection 37 is movably inserted into the elongated hole 38.

Therefore, in the state before the date display of the display wheel 4 is changed, the transmitting projection 37 of the ratchet wheel 31 is in contact with the one end section 38*a* of the elongated hole 38 positioned on the opposite side of the rotation direction of the transmitting wheel 30. As a result, the ratchet wheel 31 can be unfailingly rotated in response to the rotation of the transmitting wheel 30.

In addition, when the date display of the display wheel 4 changes, the high speed rotating wheel 26 meshes with the portion of teeth 44 of the ratchet wheel 31, thereby rotating at high speed. As a result, the transmitting projection 37 of the ratchet wheel 31 can be moved along within the elongated hole 38 of the transmitting wheel 30 at a speed higher than the rotation speed of the transmitting wheel 30.

Therefore, the ratchet wheel 31 is not affected by the rotation of the transmitting wheel 30, whereby the ratchet wheel 31 can be rotated at high speed.

In addition, the portion of teeth 44 of the ratchet wheel 31 mesh with the high speed rotating wheel 26 only while the feed wheel 32 is meshed and rotated with the ratchet wheel 31. Accordingly, in the state before the date display of the display wheel 4 is changed, the high speed rotating wheel 26 does not mesh with the portion of teeth 44 of the ratchet wheel 31. As a result, the ratchet wheel 31 can be rotated by the transmitting wheel 30 at a speed at which one revolution is made in 24 hours.

In this state, when the feed wheel 32 meshes and starts to rotate with the ratchet wheel 31, the high speed rotating wheel 26 can mesh with the portion of teeth 44 of the ratchet wheel 31 and rotate the ratchet wheel 31 at high speed, whereby the date display of the display wheel 4 can be quickly changed.

In this structure, the portion of teeth 44 of the ratchet wheel 31 are partly formed on the outer peripheral surface of the ratchet wheel 31 in the length where the portion of teeth 44 can mesh with the high speed rotating wheel 26 only while the transmitting projection 37 of the ratchet wheel 31 is moving along within the elongated hole 38 of the transmitting wheel 30.

As a result, the high speed rotating wheel 26 meshes with the portion of teeth 44 of the ratchet wheel 31 and rotates the ratchet wheel 31 at high speed while the transmitting projection 37 of the ratchet wheel 31 moves along within the elongated hole 38 of the transmitting wheel 30. Then, when the transmitting projection 37 approaches the other end section 38*b* from the one end section 38*a*, the portion of teeth 44 of the ratchet wheel 31 can be disengaged from the high speed rotating wheel 26, thereby being unmeshed with the high speed rotating wheel 26.

Therefore, the ratchet wheel 31 can be securely and favorably rotated at high speed.

In addition, the above-described pointer type wristwatch is configured as follows: the transmitting wheel 30 is rotated by the rotation of the hour hand wheel 23 that moves the hour hand 3. The high speed rotating wheel 26 is rotated at a higher speed than the transmitting wheel 30 by the rotation of the third intermediate wheel 22 that rotates the hour hand wheel 23.

The configuration can minimize the number of gears required to transmit the rotation of the third stepper motor 18 to the transmitting wheel 30 and the high speed rotating wheel 26.

As a result, the gear train can be simplified, assembly operability can be improved, and cost can be reduced.

According to the above-described embodiment, the transmitting projection 37 is formed on the ratchet wheel 31, and the elongated hole 38 is formed in the transmitting wheel 30 such that the transmitting projection 37 of the ratchet wheel 31 is movably inserted into the elongated hole 38. However, a transmitting projection may be formed on the transmitting wheel 30, and an elongated hole may be formed in the ratchet wheel 31 such that the transmitting projection of the transmitting wheel 30 is movably inserted into the elongated hole.

In addition, according to the above-described embodiment, the present invention is applied to a wristwatch having the first drive system 5 that moves the second hand 1, the second drive system 6 that moves the minute hand 2, and the third drive system 7 that moves the hour hand 3. However, the present invention is not limited thereto. For example, the present invention may be configured to include only two drive systems where the second hand 1 and the minute hand 2 is moved by one stepper motor, and the hour hand 3 is moved by another stepper motor.

Moreover, the present invention may be configured to include only one drive system where the second hand, the minute hand, and the hour hand are moved by a single stepper motor.

In addition, according to the above-described embodiment, the display wheel 4 is a date wheel having date displays. However, the display wheel 4 is not necessarily required to be a date wheel having date displays, and may be a day-of-the-week wheel having day-of-the-week displays, for example.

Furthermore, according to the above-described embodiment, the present invention is applied to a pointer type wristwatch. However, the present invention is not necessarily required to be applied to a wristwatch and can be widely applied to various pointer type timepieces, such as travel clocks, alarm clocks, mantelpiece clocks, and wall clocks.

While the present invention has been described with reference to the preferred embodiments, it is intended that the invention be not limited by any of the details of the description therein but includes all the embodiments which fall within the scope of the appended claims.

What is claimed is:

1. A pointer type timepiece comprising:

a motor;

a pointer which moves by rotation of the motor;

a rotating wheel which rotates and transmits rotation of the motor;

a ratchet wheel which is rotatably provided coaxially overlapped with the rotating wheel and provided with feed teeth in an outer peripheral portion;

a feed wheel which has a plurality of tooth sections that mesh with the feed teeth of the ratchet wheel and rotate by a predetermined angle for every one revolution of the ratchet wheel;

a display wheel which rotates by rotation of the feed wheel and changes display; and a high speed rotating wheel which rotates by rotation of the motor and rotates at a higher speed than the rotating wheel, wherein the ratchet wheel is provided with a locking section and an engaging section formed in the rotating wheel along a circumferential direction by which the locking section is movably locked into the engaging section, wherein the rotating wheel and the ratchet wheel integrally rotate when the locking section is locked into one end section of the engaging section positioned on opposite side of rotation direction of the engaging section, wherein the ratchet wheel is formed with a portion of teeth which mesh with the high speed rotating wheel only when the portion of teeth rotate the display wheel, wherein the ratchet wheel is rotated at high speed by which the high speed rotating wheel meshes with the portion of teeth, and then the locking section of the ratchet wheel moves in the rotation direction along the engaging section of the rotating wheel by the rotation of the high speed rotating wheel, and wherein the display wheel is also rotated at high speed by which the high speed rotation of the ratchet wheel is transmitted to the display wheel by the feed wheel.

2. The pointer type timepiece according to claim 1, wherein the locking section is a pin-shaped projection formed in the ratchet wheel such that the locking section projects toward the rotating wheel, and wherein the engaging section is an arc-shaped elongated hole formed in the rotating wheel such that the pin-shaped projection is movably inserted into the arc-shaped elongated hole.

3. The pointer type timepiece according to claim 1, wherein the portion of teeth of the ratchet wheel mesh with the high speed rotating wheel while the feed wheel is meshed and rotated with the ratchet wheel.

4. The pointer type timepiece according to claim 1, wherein the portion of teeth of the ratchet wheel are partly formed on an outer peripheral surface of the ratchet wheel in a length where the portion of teeth mesh with the high speed rotating wheel while the locking section of the ratchet wheel is moving along the engaging section of the rotating wheel.

5. The pointer type timepiece according to claim 1, wherein the rotating wheel is rotated by the rotation of a hand wheel that moves the hand, and the high speed rotating wheel is rotated at a higher speed than the rotating wheel by the rotation of an intermediate wheel that rotates the hand wheel.

6. A pointer type timepiece comprising:

a motor;

a pointer which moves by the rotation of the motor;

a rotating wheel which rotates and transmits rotation of the motor;

a ratchet wheel which is rotatably provided coaxially overlapped with the rotating wheel and provided with feed teeth in an outer peripheral portion;

a feed wheel which has a plurality of tooth sections that mesh with the feed teeth of the ratchet wheel and rotate by a predetermined angle for every one revolution of the ratchet wheel;

a display wheel which rotates by rotation of the feed wheel and changes display; and a high speed rotating wheel which rotates by rotation of the motor and rotates at a higher speed than the rotating wheel, wherein the ratchet wheel is provided with a locking section and an engaging section formed in the rotating wheel along a circumferential direction by which the locking section is movably locked into the engaging section, wherein the rotating wheel and the ratchet wheel integrally rotate when the locking section is locked into one end section of the engaging section positioned in rotation direction side of the engaging section, wherein the ratchet wheel is formed with a portion of teeth which mesh with the high speed rotating wheel only when the portion of teeth rotate the display wheel, wherein the ratchet wheel is rotated at high speed by which the high speed rotating wheel meshes with the portion of teeth, and then the locking section of the ratchet wheel moves in the rotation direction along the engaging section of the rotating wheel by rotation of the high speed rotating wheel, and wherein the display wheel is also rotated at high speed by which the high speed rotation of the ratchet wheel is transmitted to the display wheel by the feed wheel.

7. The pointer type timepiece according to claim 6, wherein the locking section is a pin-shaped projection formed in the rotating wheel such that the locking section projects toward the ratchet wheel, and wherein the engaging section is an arc-shaped elongated hole formed in the ratchet wheel such that the pin-shaped projection is movably inserted into the arc-shaped elongated hole.

8. The pointer type timepiece according to claim 6, wherein the portion of teeth of the ratchet wheel mesh with the high speed rotating wheel while the feed wheel is meshed and rotated with the ratchet wheel.

9. The pointer type timepiece according to claim 6, wherein the portion of teeth of the ratchet wheel are partly formed on an outer peripheral surface of the ratchet wheel in a length where the portion of teeth mesh with the high speed rotating wheel while the locking section of the rotating wheel is moving along the engaging section of the ratchet wheel.

10. The pointer type timepiece according to claim 6, wherein the rotating wheel is rotated by the rotation of a hand wheel that moves the hand, and the high speed rotating wheel is rotated at a higher speed than the rotating wheel by the rotation of an intermediate wheel that rotates the hand wheel.

* * * * *